US010598001B2

(12) United States Patent
Treviranus et al.

(10) Patent No.: US 10,598,001 B2
(45) Date of Patent: Mar. 24, 2020

(54) REMOVABLE MODULAR CONTROL ASSEMBLY

(71) Applicants: Joachim Treviranus, Aller (DE); Hans Oppelaar, Bergen (DE); Henning Melles, Celle (DE); Hendrik Joerns, Aller (DE)

(72) Inventors: Joachim Treviranus, Aller (DE); Hans Oppelaar, Bergen (DE); Henning Melles, Celle (DE); Hendrik Joerns, Aller (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 220 days.

(21) Appl. No.: 15/811,839

(22) Filed: Nov. 14, 2017

(65) Prior Publication Data

US 2019/0145245 A1 May 16, 2019

(51) Int. Cl.

| | |
|---|---|
| ***E21B 47/01*** | (2012.01) |
| ***E21B 19/16*** | (2006.01) |
| ***E21B 17/042*** | (2006.01) |

(52) U.S. Cl.

CPC ..... *E21B 47/011* (2013.01); *E21B 17/042* (2013.01); *E21B 19/16* (2013.01)

(58) Field of Classification Search

CPC ..... E21B 47/011; E21B 19/16; E21B 17/02
See application file for complete search history.

(56) References Cited

U.S. PATENT DOCUMENTS

| | | | | |
|---|---|---|---|---|
| 4,715,453 | A | 12/1987 | Falgout et al. | |
| 7,159,654 | B2 | 1/2007 | Ellison et al. | |
| 2012/0096935 | A1* | 4/2012 | Finke | E21B 47/011 73/152.03 |
| 2013/0057387 | A1 | 3/2013 | Binmore | |
| 2017/0246778 | A1 | 8/2017 | Trowbridge | |

FOREIGN PATENT DOCUMENTS

WO 9631680 A1 10/1996

OTHER PUBLICATIONS

International Search Report and Written Opinion for International Application No. PCT/US2018/060067; International Filing Date Nov. 9, 2018; dated Feb. 27, 2019 (pp. 1-16).

* cited by examiner

*Primary Examiner* — Wei Wang
(74) *Attorney, Agent, or Firm* — Cantor Colburn LLP

(57) ABSTRACT

A removable modular control assembly includes a structure including a first end portion, a second end portion, and an intermediate portion. A first interlock feature is arranged at the first end portion and a second interlock feature is arranged at the second end portion spaced from the first end portion. At least one shell member includes a first end section, a second end section and an intermediate section having at least one control module receiving section formed therein. The first end section includes a first interlock element engageable with the first interlock feature and the second end section includes a second interlock element engageable with the second interlock feature. The at least one shell member is configured to be strain locked to the structure through a lengthening of the intermediate portion.

15 Claims, 4 Drawing Sheets

REMOVABLE MODULAR CONTROL ASSEMBLY

BACKGROUND

In the resource recovery and exploration industry, various tools and sensors may be incorporated into a string of tubulars and run into a bore hole. Tools and sensors may depend upon controls such as electronics, hydraulics, sensors and the like that provide control and/or communication. The controls are typically arranged in modules that are mounted in recesses provided in a tool. After mounting, the control modules are connected and tested. After successful testing, the control module(s) are covered and run into the bore hole. The cover or covering provides protection to the control module(s) when exposed to temperatures, pressures and fluids in the bore hole. Mounting, testing, and enclosing control modules takes time during maintenance (turnaround time) at a well site. Accordingly, the industry would be receptive to systems that would allow mounting and testing in a workshop so as to reduce mounting and testing time.

SUMMARY

A removable modular control assembly includes a structure including a first end portion, a second end portion, and an intermediate portion. A first interlock feature is arranged at the first end portion and a second interlock feature is arranged at the second end portion spaced from the first end portion. At least one shell member includes a first end section, a second end section and an intermediate section having at least one control module receiving section formed therein. The first end section includes a first interlock element engageable with the first interlock feature and the second end section includes a second interlock element engageable with the second interlock feature. The at least one shell member is configured to be strain locked to the structure through a lengthening of the intermediate portion.

A resource exploration and recovery system includes a first system, a second system including a string of tubulars, and a removable modular control assembly including a structure connected to the string of tubulars including a first end portion, a second end portion, and an intermediate portion. A first interlock feature is arranged at the first end portion and a second interlock feature is arranged at the second end portion spaced from the first end portion. At least one shell member includes a first end section, a second end section and an intermediate section having at least one control module receiving portion formed therein. The first end section includes a first interlock element engageable with the first interlock feature and the second end section includes a second interlock element engageable with the second interlock feature. The at least one shell member is configured to be strain locked to the structure through a lengthening of the intermediate portion.

A method of making up a string of tubulars includes connecting a first end portion of a structure to a first tubular, positioning at least one shell member on the structure, mounting one or more control modules in an intermediate portion of the at least one shell member, connecting a second end portion of the structure to a second tubular, and joining the at least one shell member to the structure by elongating the intermediate portion.

BRIEF DESCRIPTION OF THE DRAWINGS

Referring now to the drawings wherein like elements are numbered alike in the several Figures.

DETAILED DESCRIPTION

Figure 1:
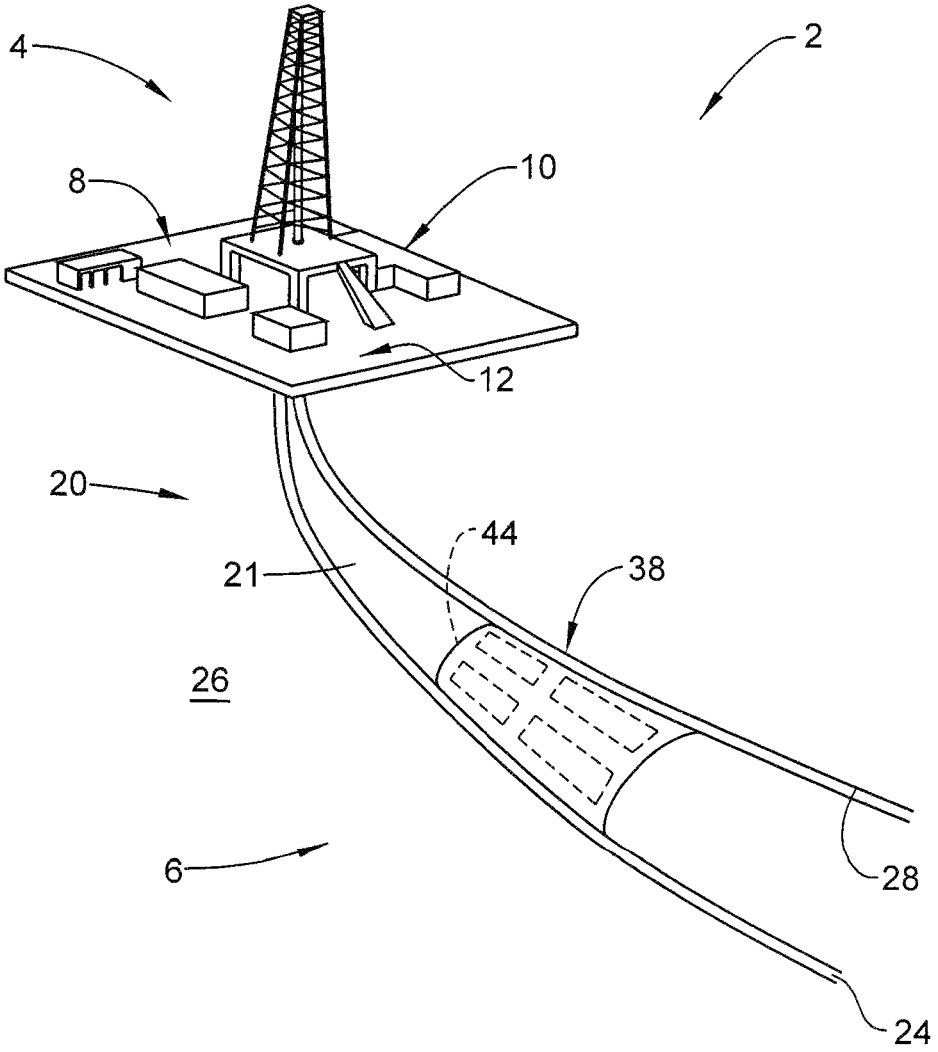
FIG. 1 depicts a resource exploration and recovery system including a removable modular control assembly, in accordance with an exemplary aspect.

A resource exploration and recovery system, in accordance with an exemplary embodiment, is indicated generally at 2, in FIG. 1. Resource exploration and recovery system 2 should be understood to include well drilling operations, resource extraction and recovery of formation fluids, $CO_2$ sequestration, and the like. Resource exploration and recovery system 2 may include a first system 4 which, in some environments, may be a surface system operatively and fluidically connected to a second system 6 which, in some environments, may be a downhole system. First system 4 may include pumps 8 that aid in completion and/or extraction processes as well as fluid storage 10. Fluid storage 10 may contain a completions fluid, a stimulation fluid or other type of fluid which may be introduced into second system 6. First system 4 may also include a control system 12 that may monitor and/or activate one or more resource exploration and recovery operations.

Second system 6 may include a tubular string 20 formed from a plurality of tubulars, one of which is indicated at 21, that is shown extended into a wellbore 24 formed in formation 26. Wellbore 24 includes an annular wall 28. Tubular string 20 may include a removable modular control assembly 38. As will be detailed herein, removable modular control assembly 38 supports pre-wired, pre-tested and/or pre-calibrated control module(s) that may be employed to control tools, communicate data to and from first system 4 as well as other functions. That is, removable modular control assembly 38 provides an electronics interface on second system 6 that is located remotely from first system 4.

Figure 2:
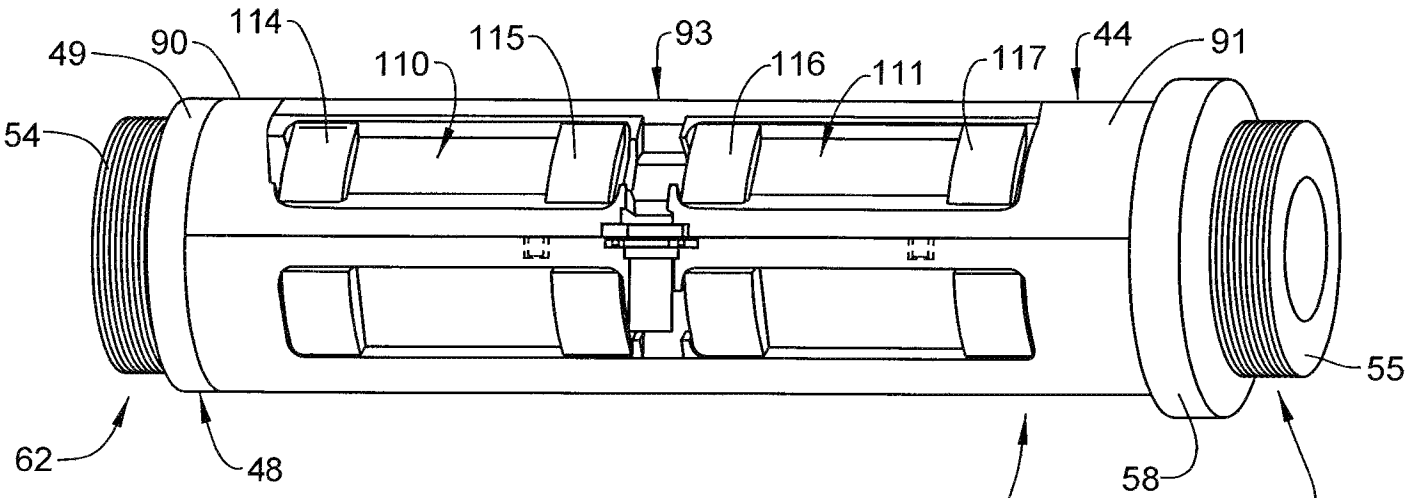
FIG. 2 depicts the removable modular control assembly, in accordance with an exemplary aspect.
Figure 3:
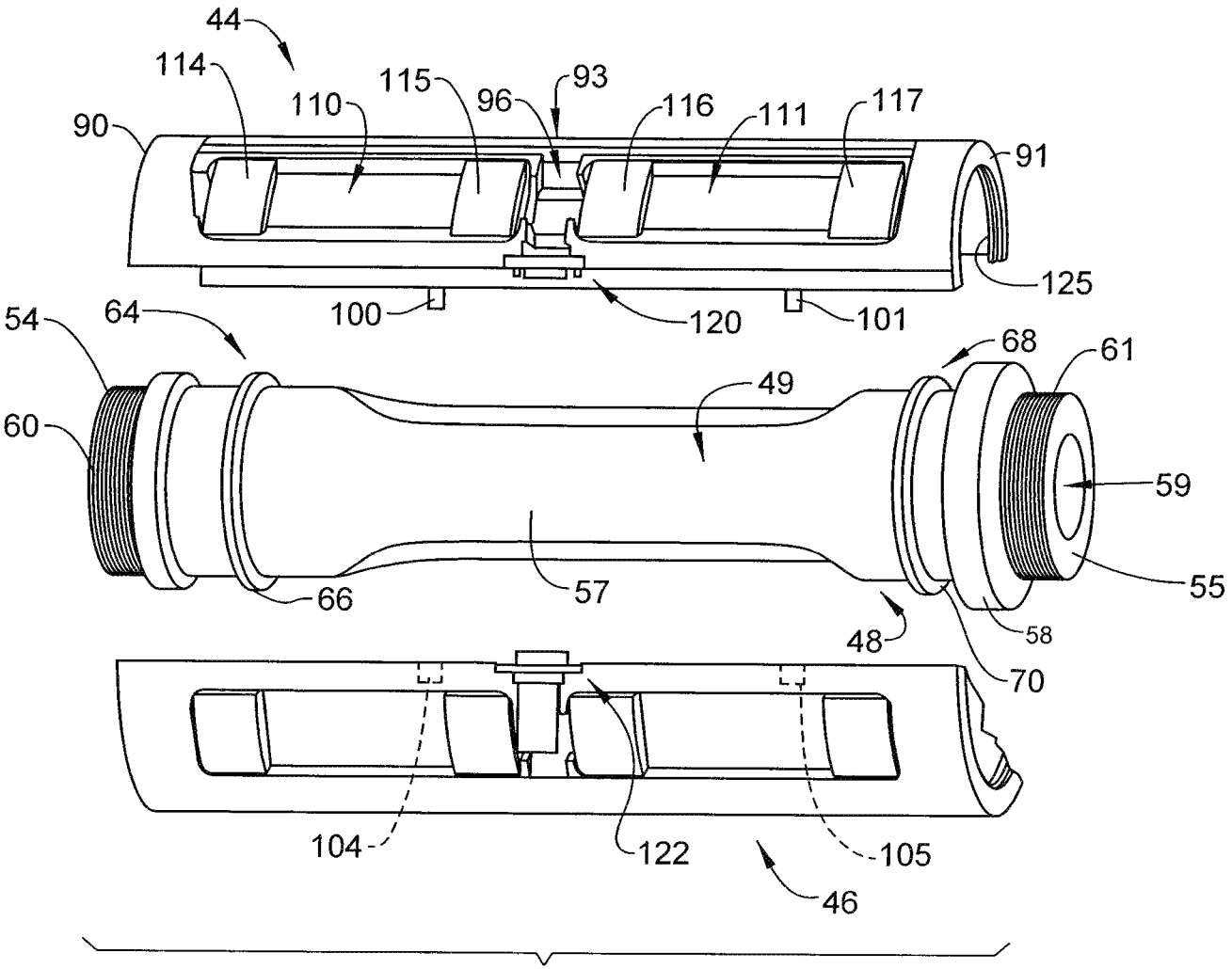
FIG. 3 depicts a partially disassembled view of the removable modular control assembly, in accordance with an aspect of an exemplary embodiment.

Referring to FIGS. 2-3 and with continued reference to FIG. 1, removable modular control assembly 38 includes a first shell member 44 and a second shell member 46 coupled to a support structure 48 that may take the form of a tubular 49. While shown as including two shell members, it should be understood that the number of shell members may vary. Support structure 48 includes a first end portion 54, a second end portion 55 and an intermediate portion 57 extending therebetween. A shoulder 58 may be arranged adjacent second end portion 55. First shell member 44 extends about a first segment (not separately labeled) of intermediate portion 57 and second shell member 46 extends about a second segment (also not separately labeled) of intermediate portion 57. Support structure 48 is also shown to include a central passage 59.

In accordance with an exemplary aspect, a first plurality of threads 60 may be provided at first end portion 54 and a second plurality of threads 61 may be provided at second end portion 55. First and second pluralities of threads 60 and 61 may establish a threaded connection with adjoining tubulars that establish a clamping force through shoulders (not separately labeled) on support structure 48 that retains first and second shell members 44 and 46. In accordance with other aspects, first and second shell members 44 and 46 may be directly clamped between adjoining tubulars.

In accordance with an aspect of an exemplary embodiment, support structure 48 includes a first interlock feature 64 arranged proximate to first end portion 54. First interlock feature 64 may take the form of a first annular rib 66 extending about and projecting radially outwardly of support structure 48. A second interlock feature 68 is arranged proximate to second end portion 55. Second interlock feature 68 may take the form of a second annular rib 70 that extends radially outwardly of support structure 48. First and second annular ribs 66 and 70 may take on a variety of profiles including rectangular, trapezoidal and the like. Also, while shown and described as being raised, first and second annular ribs 66 and 70 may constitute recesses formed in support structure 48.

Reference will continue with FIGS. 2 and 3 in describing first shell member 44 with an understanding that second shell member 46 may include similar structures. First shell member 44 includes a first end section 90, a second end section 91, and an intermediate section 93 extending therebetween. Intermediate section 93 includes a control module receiving zone 96. First shell member 44 may also include a first alignment feature or pin 100 and a second alignment feature of pin 101 that extend from intermediate section 93. First and second pins 100 and 101 may engage with corresponding ones of other alignment features such as a first pin receiver 104 and a second pin receiver 105 provided in second shell member 46. First and second pins 100 and 101 may promote a desired alignment of first shell member 44 and second shell member 46. It should be understood that other forms of alignment features may be employed to provide the desired alignment.

In accordance with an exemplary aspect, first shell member 44 supports a first control module 110 and a second control module 111 in control module receiving zone 96. It should be understood that the number and position of control modules arranged in control module receiving zone 96 may vary. It should also be understood that the particular type of control modules may vary and could include electronic control modules, hydraulic control modules, etc. First control module 110 may be secured in place through a first module retaining member 114 and a second module retaining member 115. Similarly, second control module 111 may be secured in place through a third module retaining member 116 and a fourth module retaining member 107. First and second control modules 110 and 111 are pre-wired and electrically coupled to a first electronics connector 120. First electronics connector 120 may connect with a second electronics connector 122 on second shell member 46. In this manner, first and second shell members 44 and 46 may be electrically connected to one another. A third electronics connector (not shown) may provide an electrical link to first system 4. A fourth electronics connector (also not shown) may provide an electrical link to another control assembly (not shown).

Figure 4:
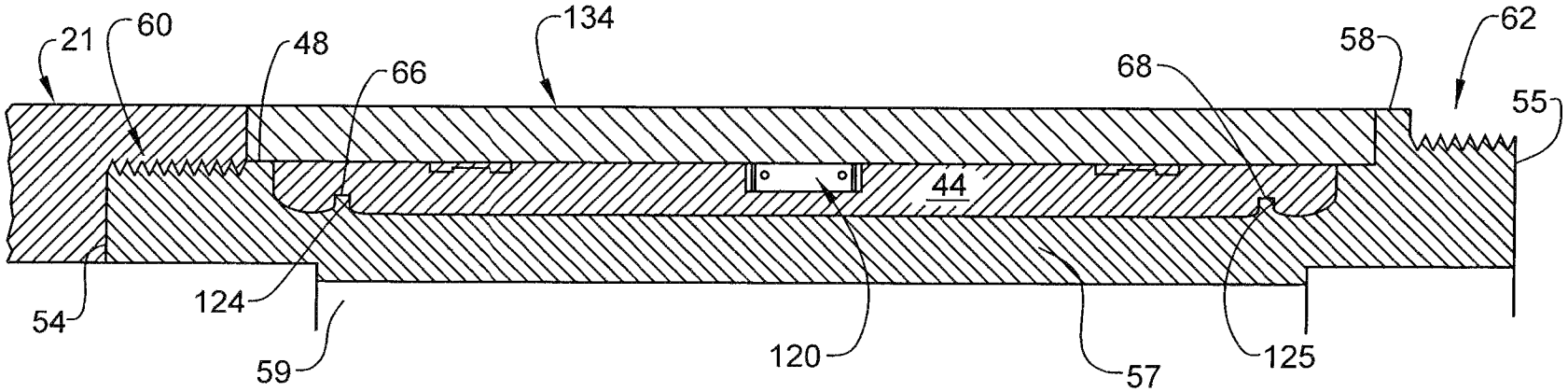
FIG. 4 depicts a cross-sectional view of the removable modular control assembly, in accordance with an aspect of an exemplary embodiment.

Referring to FIG. 4 and with continued reference to FIGS. 1-3, first shell member 44 includes a first interlock element 124 and a second interlock element 125 in accordance with an aspect of an exemplary embodiment. First interlock element 124 is arranged proximate to first end section 90 and second interlock element 125 is arranged proximate to second end section 91. First interlock element 124 is sized and shaped to receive first interlock feature 64. Second interlock element 125 is sized and shaped to receive second interlock feature 68. Second shell member 46 may include similar interlock elements (not separately labeled).

First and second shell member 44 and 46 may be constructed remote from resource exploration and recovery system 2. For example, control modules 110 and 111 as well as additional control modules may be mounted to first and second shell members 44 and 46, connected and tested prior to being brought to, for example, first system 4. After being configured, first shell member 44 may be mounted to support structure 48 with first and second interlock elements 124 and 125 connecting with first and second interlock features 64 and 68. Second shell member 46 may be similarly mounted. First electronics connector 120 may be connected with second electronics connector 122 and removable modular control assembly 38 may be coupled to another conductor (not shown) that connects with first system 4.

Once mounted to support structure 48, a protective cover or sleeve 134 may be installed over first and second shell members 44 and 46. Sleeve 134 may be held in place by a compressive force generated by a connection to tubular 21. That is, when first end portion 54 is connected to tubular string 20, sleeve 134 may be compressed between shoulder 58 and tubular 21. Of course, it should be understood, that sleeve 134 may be compressed between a tubular connected to first end portion 54 and a tubular connected to second end portion 55. That is, support member 48 may be formed without shoulder 58.

At this point, support structure 48 may be elongated along an axis that passes through first end portion 54 and second end portion 55. Elongation of support structure 48 causes interlock features 64, 68 and interlock elements 124, 125 to inter-engage creating a strain locked configuration. Inter-engagement of interlock features 64, 68 and interlock elements 124, 125 affixes first and second shell members 44 and 46 to support structure 48. In this manner, control modules may be added to a tubular string with minimal interruption in maintenance time.

Set forth below are some embodiments of the foregoing disclosure:

Embodiment 1

A removable modular control assembly comprising a structure including a first end portion, a second end portion, and an intermediate portion, a first interlock feature is arranged at the first end portion and a second interlock feature is arranged at the second end portion spaced from the first end portion, and at least one shell member having a first end section, a second end section and an intermediate section having at least one control module receiving section formed therein, the first end section including a first interlock element engageable with the first interlock feature and the second end section including a second interlock element engageable with the second interlock feature, the at least one shell member being configured to be strain locked to the structure through a lengthening of the intermediate portion.

Embodiment 2

The removable modular control assembly according to any prior embodiment, wherein the at least one shell member comprises a first shell member extending about a first segment of the intermediate portion and a second shell member extending about a second segment of the intermediate portion.

Embodiment 3

The removable modular control assembly according to any prior embodiment, wherein the first shell member includes a first alignment feature and the second shell member includes another alignment feature that establish a selected alignment between the first shell member and the second shell member.

Embodiment 4

The removable modular control assembly according to any prior embodiment, wherein the first shell member includes a first electronics connector and the second shell member includes a second electronics connector configured to electrically connect with the first electronics connector.

Embodiment 5

The removable modular control assembly according to any prior embodiment, wherein the at least one shell member includes an electronics connector.

Embodiment 6

The removable modular control assembly according to any prior embodiment, wherein at least one of the first end portion and the second end portion of the structure includes a plurality of threads.

Embodiment 7

A resource exploration and recovery system comprising a first system, a second system including a string of tubulars, and a removable modular control assembly comprising a structure connected to the string of tubulars including a first end portion, a second end portion, and an intermediate portion, a first interlock feature is arranged at the first end portion and a second interlock feature is arranged at the second end portion spaced from the first end portion, and at least one shell member having a first end section, a second end section and an intermediate section having at least one control module receiving portion formed therein, the first end section including a first interlock element engageable with the first interlock feature and the second end section includes a second interlock element engageable with the second interlock feature, the at least one shell member being configured to be strain locked to the structure through a lengthening of the intermediate portion.

Embodiment 8

The resource exploration and recovery system according to any prior embodiment, wherein the at least one shell member comprises a first shell member extending about a first segment of the intermediate portion and a second shell member extending about a second segment of the intermediate portion.

Embodiment 9

The resource exploration and recovery system according to any prior embodiment, wherein the first shell member includes a first alignment feature and the second shell member includes another alignment feature that establish a selected alignment between the first shell member and the second shell member.

Embodiment 10

The resource exploration and recovery system according to any prior embodiment, wherein the first shell member includes a first electronics connector and the second shell member includes a second electronics connector configured to electrically connect with the first electronics connector.

Embodiment 11

The resource exploration and recovery system according to any prior embodiment, wherein the at least one shell member includes an electronics connector.

Embodiment 12

The resource exploration and recovery system according to any prior embodiment, wherein at least one of the first end portion and the second end portion of the structure includes a plurality of threads.

Embodiment 13

A method of making up a string of tubulars comprising connecting a first end portion of a structure to a first tubular, positioning at least one shell member on the structure, mounting one or more control modules in an intermediate portion of the at least one shell member, connecting a second end portion of the structure to a second tubular; and joining the at least one shell member to the structure by elongating the intermediate portion.

Embodiment 14

The method of any prior embodiment, wherein elongating the intermediate portion includes making up a threaded connection at the second end portion of the structure.

Embodiment 15

The method of any prior embodiment, wherein joining the at least one shell member to the structure includes positioning a first interlock element on the at least one shell member with a first interlock feature at the first end portion of the structure, and a second interlock element on the at least one shell member with a second interlock feature at the second end portion of the structure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. A removable modular control assembly comprising:

a structure including a first end portion, a second end portion, and an intermediate portion, a first interlock feature is arranged at the first end portion and a second interlock feature is arranged at the second end portion spaced from the first end portion; and at least one shell member having a first end section, a second end section and an intermediate section having at least one control module receiving section formed therein, the first end section including a first interlock element engageable with the first interlock feature and the second end section including a second interlock element engageable with the second interlock feature, the at least one shell member being strain locked to the structure through a lengthening of the intermediate portion.

2. The removable modular control assembly according to claim 1, wherein the at least one shell member comprises a first shell member extending about a first segment of the intermediate portion and a second shell member extending about a second segment of the intermediate portion.

3. The removable modular control assembly according to claim 2, wherein the first shell member includes at least alignment feature and the second shell member includes a second alignment feature that establish a selected alignment between the first shell member and the second shell member.

4. The removable modular control assembly according to claim 2, wherein the first shell member includes a first electronics connector and the second shell member includes a second electronics connector configured to electrically connect with the first electronics connector.

5. The removable modular control assembly according to claim 1, wherein the at least one shell member includes an electronics connector.

6. The removable modular control assembly according to claim 1, wherein at least one of the first end portion and the second end portion of the structure includes a plurality of threads.

7. A resource exploration and recovery system comprising:

a first system;

a second system including a string of tubulars; and a removable modular control assembly comprising:

a structure connected to the string of tubulars including a first end portion, a second end portion, and an intermediate portion, a first interlock feature is arranged at the first end portion and a second interlock feature is arranged at the second end portion spaced from the first end portion; and at least one shell member having a first end section, a second end section and an intermediate section having at least one control module receiving portion formed therein, the first end section including a first interlock element engageable with the first interlock feature and the second end section includes a second interlock element engageable with the second interlock feature, the at least one shell member being strain locked to the structure through a lengthening of the intermediate portion.

8. The resource exploration and recovery system according to claim 7, wherein the at least one shell member comprises a first shell member extending about a first segment of the intermediate portion and a second shell member extending about a second segment of the intermediate portion.

9. The resource exploration and recovery system according to claim 8, wherein the first shell member includes a first alignment feature and the second shell member includes another alignment feature, that establish a selected alignment between the first shell member and the second shell member.

10. The resource exploration and recovery system according to claim 8, wherein the first shell member includes a first electronics connector and the second shell member includes a second electronics connector configured to electrically connect with the first electronics connector.

11. The resource exploration and recovery system according to claim 7, wherein the at least one shell member includes an electronics connector.

12. The resource exploration and recovery system according to claim 7, wherein at least one of the first end portion and the second end portion of the structure includes a plurality of threads.

13. A method of making up a string of tubulars comprising:

connecting a first end portion of a structure to a first tubular;

positioning at least one shell member on the structure;

mounting one or more control modules in an intermediate portion of the at least one shell member;

connecting a second end portion of the structure to a second tubular; and strain locking the at least one shell member to the structure by elongating the intermediate portion.

14. The method of claim 13, wherein elongating the intermediate portion includes making up a threaded connection at the second end portion of the structure.

15. The method of claim 13, wherein joining the at least one shell member to the structure includes positioning a first interlock element on the at least one shell member with a first interlock feature at the first end portion of the structure, and a second interlock element on the at least one shell member with a second interlock feature at the second end portion of the structure.

* * * * *